US005873263A

United States Patent [19]

Chang

[11] Patent Number: 5,873,263

[45] Date of Patent: Feb. 23, 1999

[54] EQUIPMENT AND PROCESS FOR FLUID PURIFICATION AND RECOVERY

[75] Inventor: Ching-Hui Chang, Hsinchu, Taiwan

[73] Assignee: Industrial Technology Research Institute, Hsinchu, Taiwan

[21] Appl. No.: 840,849

[22] Filed: Apr. 17, 1997

[51] Int. Cl.[6] ..... F25J 1/00

[52] U.S. Cl. ..... 62/617; 62/114; 203/41

[58] Field of Search ..... 62/617, 114; 203/41

[56] References Cited

U.S. PATENT DOCUMENTS

| | | | |
|---|---|---|---|
| 3,181,305 | 5/1965 | Schoenfelder | 62/908 |
| 3,367,847 | 2/1968 | Pierson | 203/41 |
| 3,806,609 | 4/1974 | Goblik et al. | 203/41 |
| 3,866,428 | 2/1975 | Simonet et al. | 62/908 |
| 4,337,071 | 6/1982 | Yang | 62/908 |
| 4,717,406 | 1/1988 | Giacobbe | 62/908 |
| 5,379,607 | 1/1995 | Sergius . | |
| 5,390,503 | 2/1995 | Cheng . | |
| 5,412,955 | 5/1995 | Husarik et al. . | |
| 5,414,200 | 5/1995 | Mouk et al. . | |
| 5,434,045 | 7/1995 | Jost . | |
| 5,457,966 | 10/1995 | Nivens . | |
| 5,474,018 | 12/1995 | Lopez . | |
| 5,509,790 | 4/1996 | Schuderi et al. . | |
| 5,522,237 | 6/1996 | Wardle . | |
| 5,559,278 | 9/1996 | Mouk et al. . | |

*Primary Examiner*—Ronald Capossela
*Attorney, Agent, or Firm*—Pollock, Vande Sande & Amernick, R.L.L.P.

[57] ABSTRACT

Equipment and process for fluid purification and recovery for separating at least two matters contained in a gas or fluid including cooling a fluid to a low temperature range by use of a cooling system so that the matters in the fluid exhibit at least two phases, and filtering at least one of the matters using a filter device. The fluid may be distilled using a heating system prior to its entrance into the cooling system so as to help separate and purify the matters.

17 Claims, 6 Drawing Sheets

EQUIPMENT AND PROCESS FOR FLUID PURIFICATION AND RECOVERY

BACKGROUND OF THE INVENTION

1. Field of the Invention

The present invention relates generally to a process for fluid recovery, and more particularly to a process in which filtration and purification take place after matters in a fluid are caused to exhibit different phases by cooling.

The process of the present invention may be applied to the purification of various fluids such as gas and liquid. More particularly, the process is adapted for use in the recycling, purification and recovery of refrigerant in a refrigeration system.

2. Description of the Related Art

As is well known to those skilled in refrigeration systems, refrigerant is being recycled and reused in a refrigeration system, and the used refrigerant is repeatedly recovered and reprocessed so as to enhance its purity and hence its heat exchange capacity, which helps to keep the refrigeration system in good conditions.

The process of recovering refrigerants generally falls into two main types: the compressive type and the non-compressive type. In the former, the compressor serves as a driving element to compress or transport the refrigerant. In the latter, by means of the differences in temperature and pressure generated by a refrigeration unit on the refrigerant located in at least two regions of the refrigeration system, the refrigerant is returned via the filter to the recovery equipment. For the process of recovering refrigerant using the compressor, the lubricant in the equipment that has good solubility in refrigerant may easily dissolve in the refrigerant and be carried away in it. The compressor may be damaged due to loss of lubricant. For refrigerant recovery systems not using compressors, the lubricant may be carried by the refrigerant into the cooling tank of the recovery equipment, thus contaminating the recovered refrigerant. Besides, the lubricant will stick to the cooling unit in the cooling tank so that the heat transfer efficiency of the cooling unit drops, damaging the system. In addition, during the process of recovery, since the amount of refrigerant in the refrigeration system will gradually decrease, space occupied by gaseous refrigerant will gradually increase so that pressure drops. Consequently, the differences in temperature and pressure between the refrigerant in the recovery equipment and the refrigerant in the refrigeration system are reduced. In other words, the rate of refrigerant recovery will continue to drop to further lower the recovery efficiency.

In the related art, there has been taught a refrigerant recovering and purging system utilizing heating and evaporation, and filtration equipment with windows for purifying the refrigerant. Such prior art systems are all directed to use of filtration apparatus and evaporation to achieve purification of refrigerant. In U.S. Pat. No. 5,379,607, which describes a refrigerant recovery and recycling system in which the refrigerant is separated by distillation. Said patent also-teaches use of waste heat produced by the compressor to distill liquid refrigerant from liquid contaminants.

Although heating and evaporation may substantially separate the two matters in the fluid, the separation is not complete. Take refrigerant-as an example. While water and refrigerant may readily dissolve in each other, and refrigerant very readily attracts water molecules, water is also the greatest contaminating source of refrigerant. There will be some water moisture left in the vaporized refrigerant when using prior evaporation techniques.

SUMMARY OF THE INVENTION

A primary object of the present invention is to provide use of a cooling technique to separate matters in a fluid. The technique is applicable to refrigerant recovery systems and the recovery of gas or liquid comprising at least two matters.

Another object of the present invention is to provide fluid recovery equipment comprising a distillation purification system and a cooling filtration system to enhance the purification of fluids and speed up recovery operation. The equipment may be used in the recovery and recycling of refrigerant or other fluids.

A further object of the present invention is to provide fluid recovery equipment which may utilize the waste heat produced at a low temperature side of a refrigeration unit so that the fluid is cooled to a two-phase state to facilitate separation.

Still another object of the present invention is to provide fluid recovery equipment which utilizes the waste energy generated at a high temperature side and a low temperature side of a refrigeration unit.

Still a further object of the present invention is to provide a fluid recovery system, in which an oil-free air transfer pump is used to transport the gaseous fluid so as to maintain the purity of the fluid.

In order to achieve the aforementioned objects, the technique provided by the present invention employs a cooling system to cool a fluid mixture into a low temperature range so that the mixture exhibits at least two phases. A filter is then used to filter off at least one of the matters in the mixture. Before the fluid mixture enters the cooling system, a heating system may be used to distill the fluid mixture so as to help separate and purify the matters in the mixture. The present invention utilizes the waste energy generated at a low temperature side of a refrigeration unit to cool the mixture into a two-phase mixture. The waste heat generated at a high temperature side of the refrigeration unit is further used to distill the mixture. The distilled gaseous fluid may be transported using an oil-free type air pump.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 6:
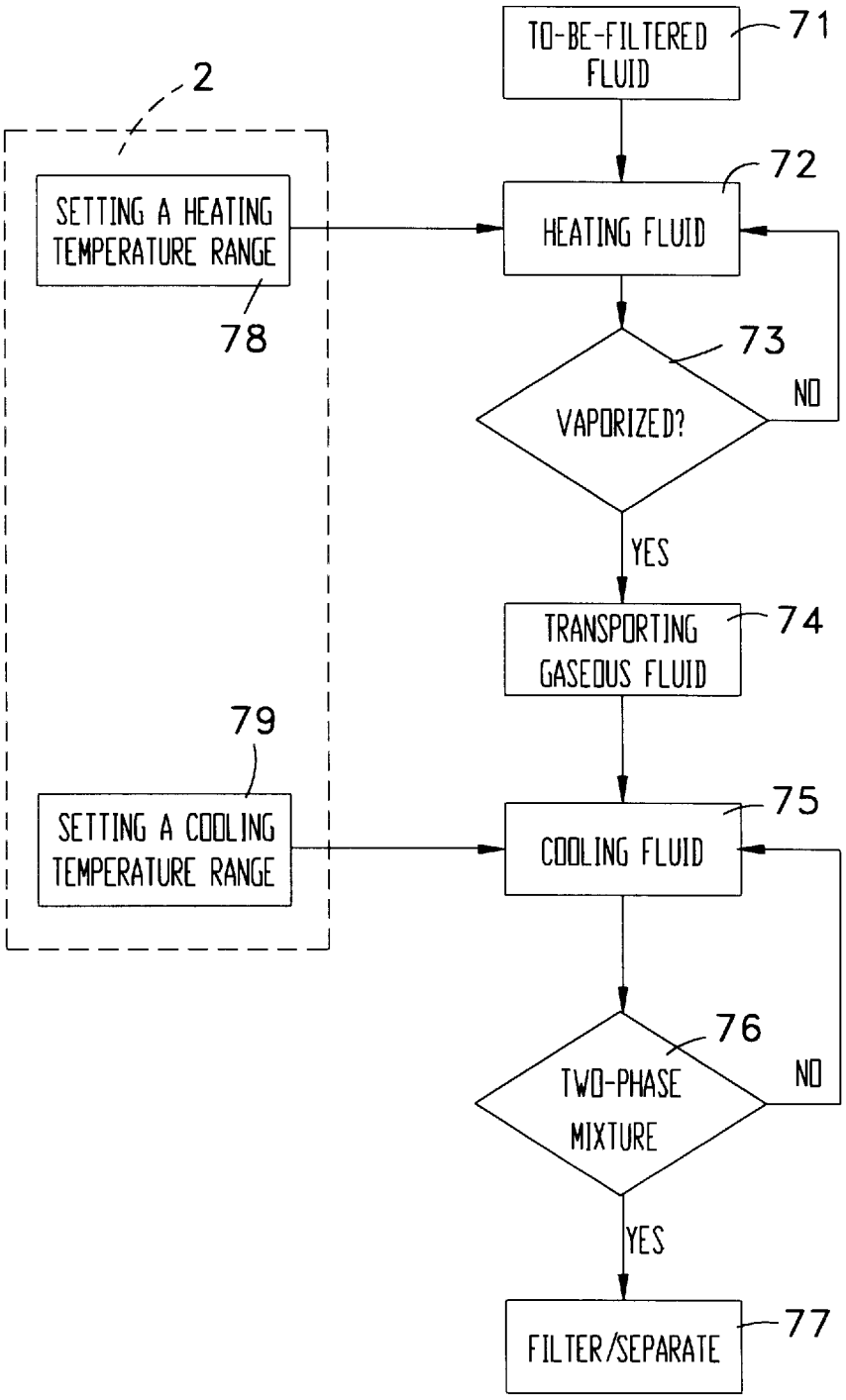
FIG. 6 is a flow-chart of the fluid recovery process according to the present invention.

The process for fluid purification and recovery according to the present invention is adapted for use in purifying and recovering fluids comprising at least two matters. The flowchart of the process is shown in FIG. 6. The to-be-filtered fluid (71) is preheated (72) in a device controlled by a predetermined heating temperature range (78). If one of the matters in the fluid has become vaporized (73), then the gaseous fluid (74) is transported to a cooling device (75) controlled by a predetermined heating temperature range (79). Since there are residual matters in the gaseous fluid, after cooling, the mixture will exhibit different phases (76). The fluid is then filtered to isolate the different matters therein (77).

Figure 1:
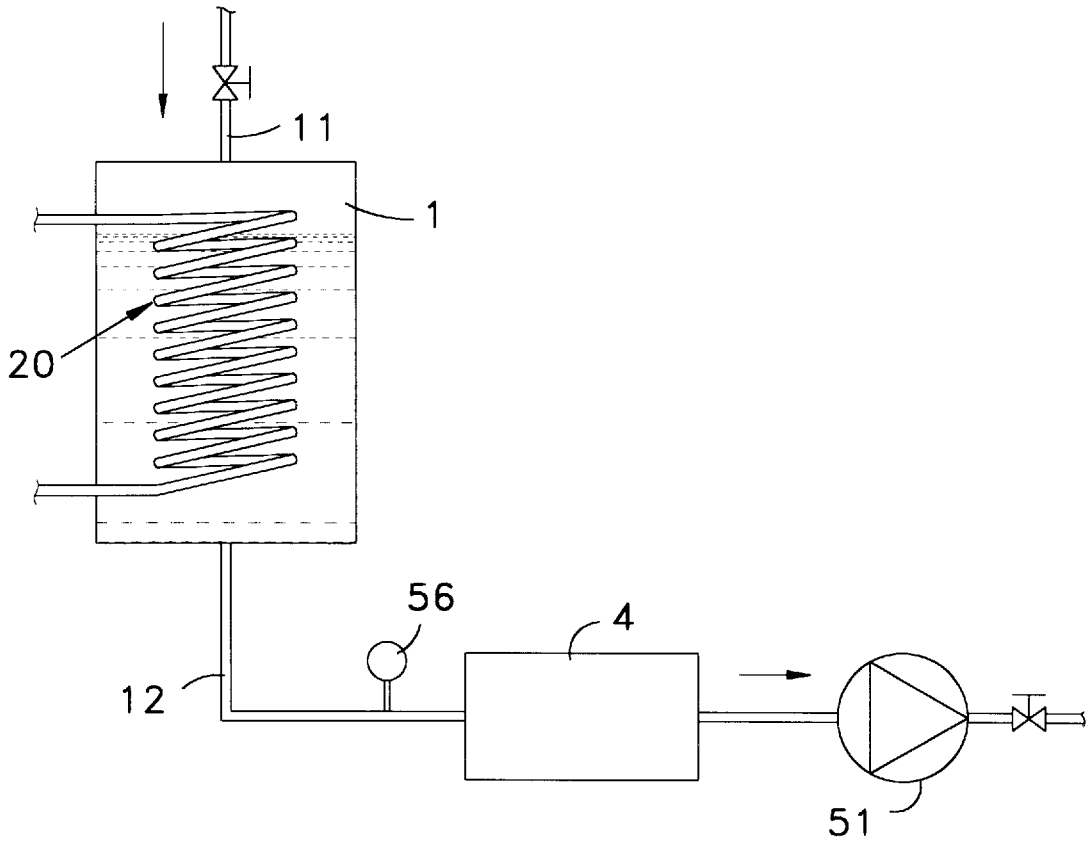
FIG. 1 is a schematic view illustrating the technique of cooling fluid recovery of the present invention.

According to the purification technique characterizing the present invention, the fluid mixture is cooled by a cooling vessel 1 to a low temperature range using the equipment shown in FIG. 1. When the-mixture exhibits at least two different phases, the mixture is preferably passed through a filter device 4 to filter off at least one of the matters in the mixture so that the mixture now exhibits at least one phase. The above-mentioned process is used to cool the fluid mixture into a mixture of liquid and solid, or a mixture of gas and liquid, or a mixture of gas, liquid and solid. In practice, preferably, a best example of the fluid is refrigerant, and the low temperature range temperature is preferably between 0° C. and 50° C. In this way, commonly used refrigerants such as R11, R12, R22 and R-134*a* may be purified to be completely separated from oil and/or water.

Figure 3:
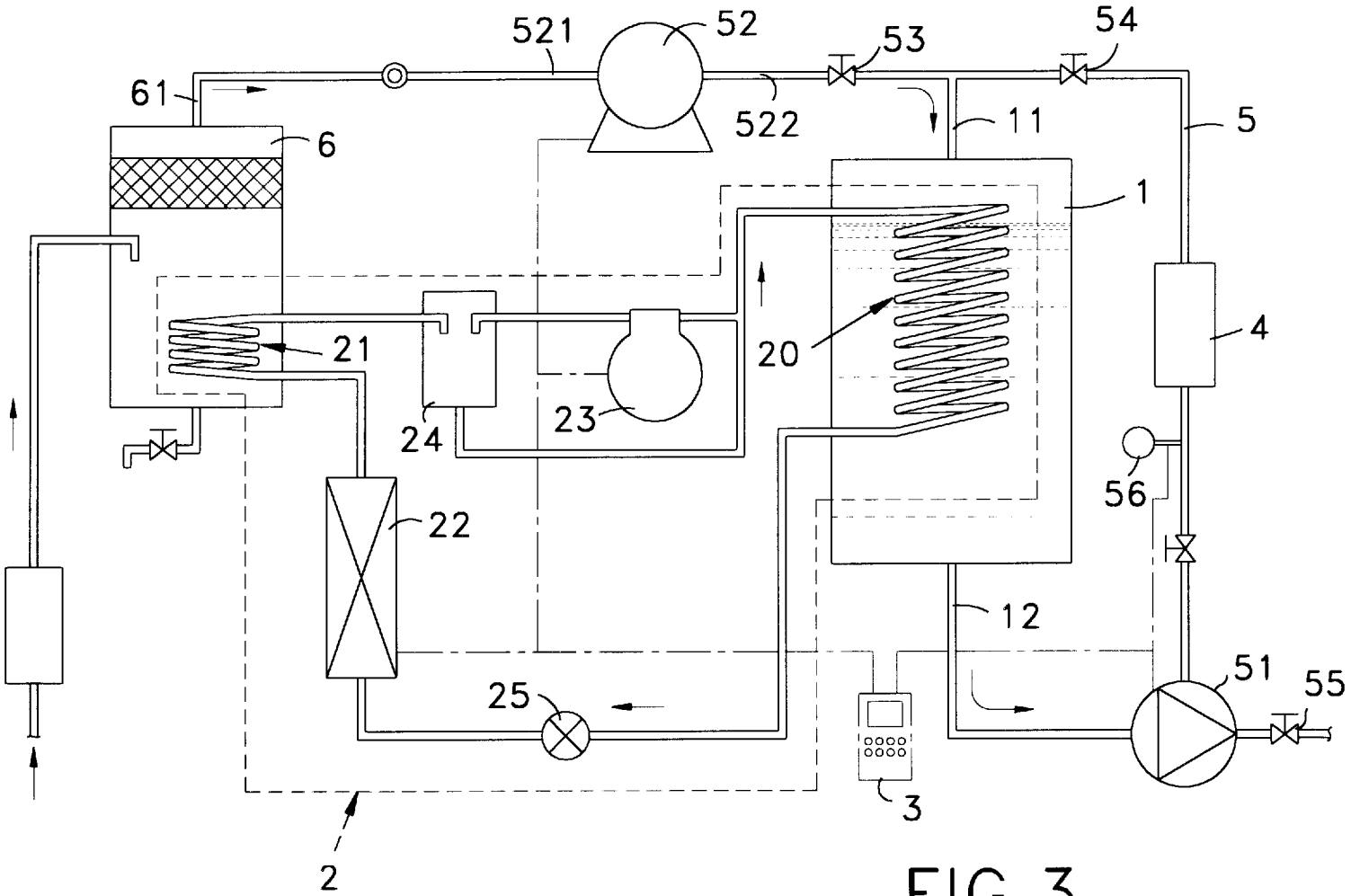
FIG. 3 is a system diagram illustrating fluid purification and recovery equipment of the present invention, showing use of the waste energy generated by a refrigeration unit.
Figure 4:
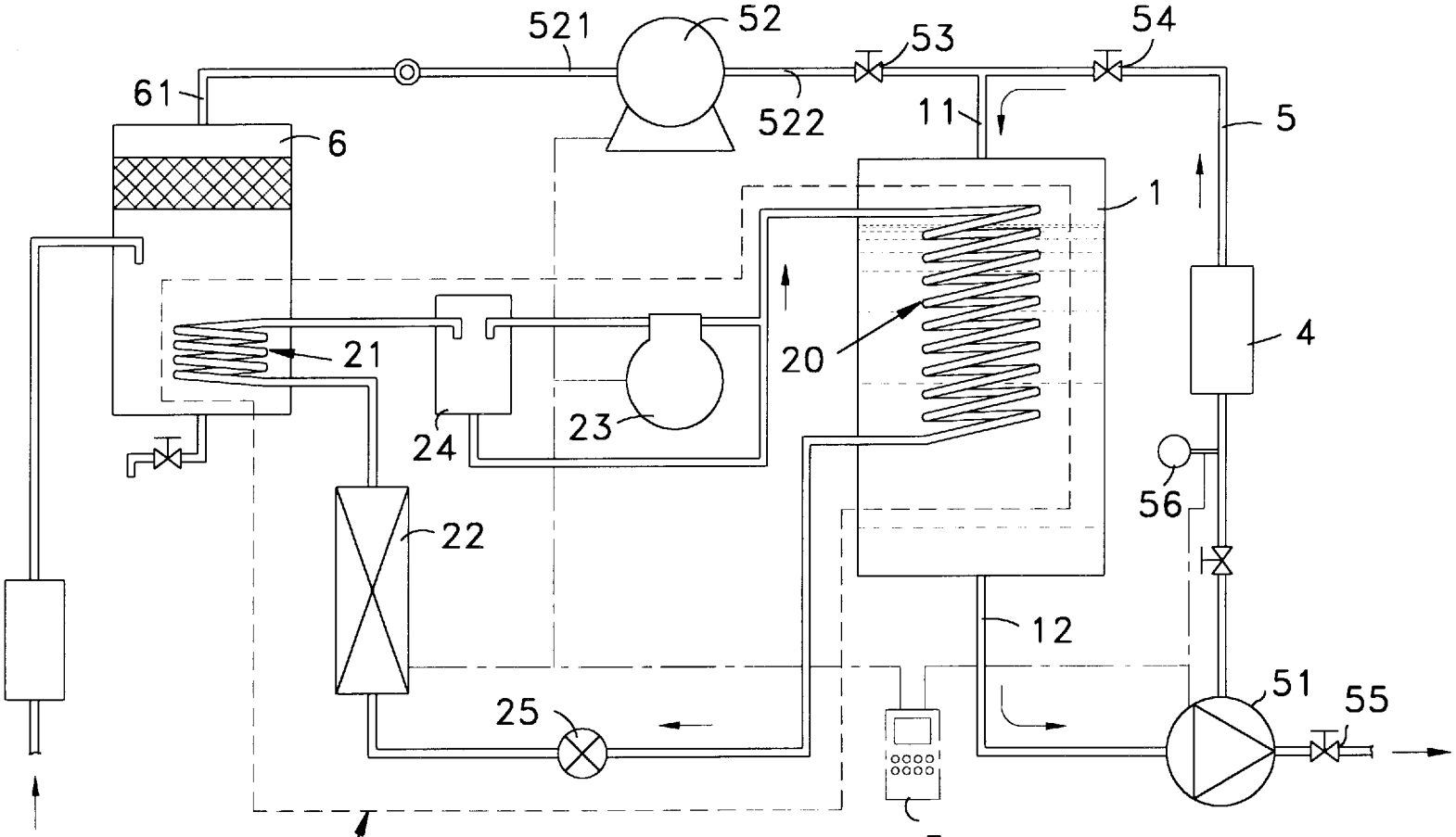
FIG. 4 is similar to FIG. 3, but showing another operational state.
Figure 5:
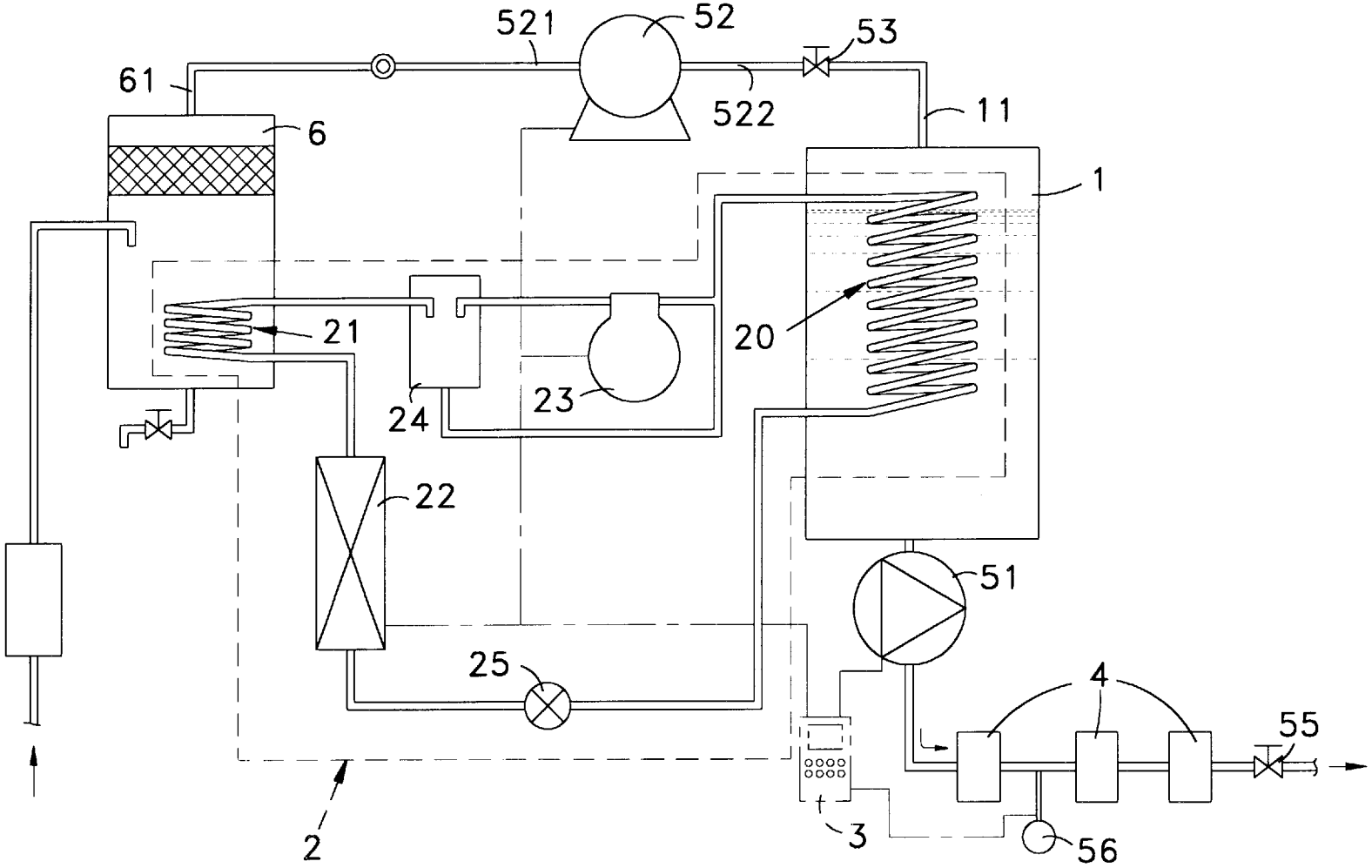
FIG. 5 is similar to FIG. 3, but showing the state wherein the filter device comprises of filter devices connected in series.

Another feature of the present invention is shown in FIGS. 3–5. The waste energy generated by a refrigeration system 2 may be exploited. In other words, the waste energy at the low temperature side of the refrigeration system 2 may be supplied to the above-mentioned cooling and purification systems to serve as a cooling device therefor. At the same time, the waste heat generated at the high temperature side may be utilized to serve as a heating device for the purification system to heat the fluid.

The equipment shown in FIGS. 3–5 may be used to accomplish the process of the invention. The equipment essentially comprises a cooling vessel 1 having a fluid inlet 11, a fluid outlet 12, and a cooling device 20 operable to cool the fluid entering the cooling vessel 1. The equipment further comprises a cooling temperature setting device 3 for determining a cooling temperature range for the cooling device 20; a filter device 4 connected to the pipes behind the fluid outlet 12 of the cooling vessel 1; and a piping system 5 connecting the cooling vessel 1 and the filter device 4. Since the above purification equipment and refrigeration system 2 are completely different systems, they may be connected in the piping system 5 by a transfer pump 51. The above filter device 4 may be a single filter or a plurality of filters connected in series as shown in FIG. 5.

When the cooling device 2 has cooled the fluid mixture in the cooling vessel 1 to such an extent that it exhibits two different phases, the mixture may be further filtered. In the process shown in FIG. 4, in which a series of filters are used, valves 53 and 55 are closed while valves 54 is opened, and the pump 51 is actuated. Then the cooling vessel 1, the filter device 4, the piping system 5 and the oil-free type air pump 51 will together form a cyclic filtration circuit.

The equipment provided by the present invention further comprises a distillation device 6 having a gas outlet 61, and a heating device 21 for supplying heat to the distillation device 6. The above-mentioned pump 52 has an inlet end 521 and an outlet end 522, the inlet end 521 being connected to the gas outlet 61 of the distillation device 6, with the outlet end 522 connected to the fluid inlet 11 of the cooling vessel 1 by means of the piping system.

For both the embodiments shown in FIGS. 3 and 5, it is preferable to provide a sensor 56 in front of the filter device 4 for detecting and determining the capacity of the filter device 4. When the sensed capacity drops, the operators will know that cleaning or replacement of filter components are required. The sensor 56 may be any suitable sensor element, for instance, a fluid manometer. When the detected pressure is excessively high, indicating that the interior of the filter device 4 is blocked by excessive matters, the filter device 4 will need to be cleaned.

Figure 2:
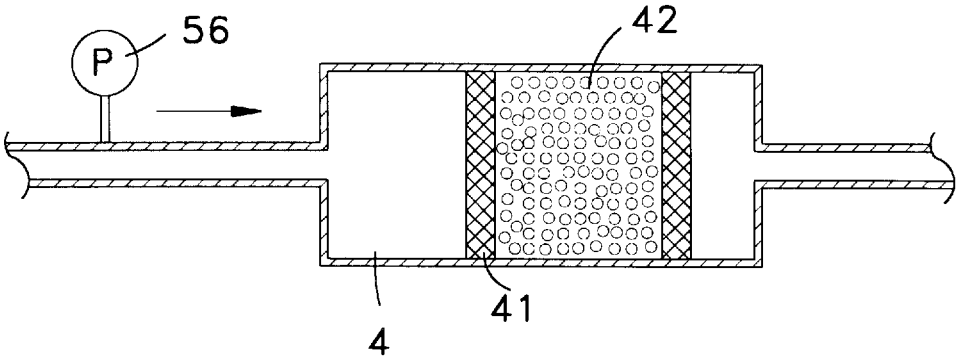
FIG. 2 is a schematic sectional view of a preferred embodiment of the filter device shown in FIG. 1.

The filter device 4 may also have any suitable form,. which is determined by the kind of matter to be filtered. For instance, in the purification of refrigerant, as shown in FIG. 2, in addition to having a filter mesh 41 for filtering off impurities, the filter device 4 may further comprise filtering materials such as driers 42.

The above-mentioned embodiment of the process of fluid purification using a cooling system comprises:

1. Cooling a Gaseous Fluid to Become a Mixture of Liquid and Solid

Take R11 as an example. If the temperature of the cooling range of the cooling vessel 1 is between −5° and −15° C., residual water in the vaporized refrigerant transported into the cooling vessel 1 will condense into tiny pieces of ice while refrigerant will be cooled to form liquid refrigerant. Therefore, separation of water from refrigerant is easy.

Supposing the temperature of the cooling range drops to below −50° C., residual oil in the fluid may be caused to become solidified so that is may be easily removed from the refrigerant.

2. Cooling a Gaseous Fluid to Become a Mixture of Liquid and Gas

Take R12 (used in cars) or R22 (used in window air conditioners) as an example. Their respective freezing points are −29° C. and −40° C.

When the temperature of the cooling range of the cooling vessel 1 is set above 0° C., the moisture in the fluid will condense into liquid while refrigerant will remain as a gas. It is therefore easy to separate water from the gaseous refrigerant to obtain purified refrigerant.

Although the present invention has been illustrated and described with reference to the preferred embodiments thereof, it should be understood that it is in no way limited to the details of such embodiments, but is capable of numerous modifications within the scope of the appended claims.

What is claimed is:

1. A process for fluid purification and recovery, comprising the steps of:

heating a mixture of fluids in a high temperature range so that at least one of the fluids becomes a gas;

transporting the gaseous fluid to a cooling system;

cooling the gaseous fluid to a low temperature range so that the mixture of fluids exhibits at least two different phases to allow separation; and transporting the mixture exhibiting at least two different phases to a filter devices for filtration and separation.

2. A process for fluid purification and recovery as claimed in claim 1, further comprising the step of supplying the energy generated at a low temperature side of a refrigeration system to the cooling system.

3. A process for fluid purification and recovery as claimed in claim 1, further comprising the step of providing the thermal energy generated at a high temperature side of the refrigeration system for the heating of the fluid mixture.

4. A process for fluid purification and recovery as claimed in claim 1, wherein an oil-free type air pump is used to transfer the gaseous fluid.

5. A process for fluid purification and recovery, comprising cooling a fluid mixture to a low temperature range and, when the mixture exhibits two different phases, passing the mixture into a filter device to filter off at least one of the fluids.

6. A process for fluid purification and recovery as claimed in claim 5, wherein the fluid mixture is cooled to form a mixture of liquid and solid.

7. A process for fluid purification and recovery as claimed in claim 5, wherein the fluid mixture is cooled to form a mixture of gas and liquid.

8. A process for fluid purification and recovery as claimed in claim 5, wherein the fluid mixture is cooled to form a mixture of gas, liquid and solid.

9. A process for fluid purification and recovery as claimed in claim 5, wherein refrigerant is selected as a fluid of the mixture, and the low temperature range is set between 0° C. and 50° C.

10. Apparatus for fluid purification and recovery, comprising:

a cooling vessel having a fluid inlet, a fluid outlet, and a cooling device for cooling the fluid entering the cooling vessel;

a cooling temperature setting device associated with said cooling device for setting a cooling temperature range:

a filter device connected to said fluid outlet of said cooling vessel;

means for causing fluid to be purified to flow in said fluid inlet of said cooling vessel, and means including a piping system connecting said cooling vessel and said filter device for causing cooled fluid exiting said fluid outlet to be fed to said filter device for separation thereof.

11. Apparatus for fluid purification and recovery as claimed in claim 10, further comprising an oil-free air pump connected to said piping system.

12. Apparatus for fluid purification and recovery as claimed in claim 10, said filter device comprises a plurality of filters connected in series.

13. Apparatus for fluid purification and recovery as claimed in claim 11, wherein said cooling vessel, said filter device, said piping system, and said oil-free air pump together form a circulation circuit.

14. Apparatus for fluid purification and recovery as claimed in claim 10, further comprising:

an evaporation device having a gas outlet, and a heating device for supplying heat to said evaporation device; and a pump having an inlet end and an outlet end, said inlet end being connected to said gas outlet of said evaporation device, and said outlet end being connected to said fluid inlet of said cooling vessel by means of said piping system.

15. Apparatus for fluid purification and recovery as claimed in claim 10, wherein said piping system comprises a sensor for detecting the status of said filter device.

16. Apparatus for fluid purification and recovery as claimed in claim 10, wherein said cooling device is a low temperature side of refrigeration equipment.

17. Apparatus for fluid purification and recovery as claimed in claim 10, said heating device is a high temperature side of refrigeration equipment.

* * * * *